US005623716A

United States Patent [19]

Masaki et al.

[11] Patent Number: 5,623,716

[45] Date of Patent: Apr. 22, 1997

[54] PROCESS FOR IMAGE FORMING USING A PHOTOSENSITIVE MEMBER HAVING AN AMORPHOUS CARBON LAYER AS AN OUTERMOST SURFACE LAYER

[75] Inventors: Kenji Masaki, Ibaragi; Izumi Osawa, Ikeda; Seishi Ojima, Takatsuki, all of Japan

[73] Assignee: Minolta Camera Kabushiki Kaisha, Osaka, Japan

[21] Appl. No.: 215,169

[22] Filed: Mar. 21, 1994

Related U.S. Application Data

[63] Continuation of Ser. No. 946,679, Sep. 18, 1992, abandoned.

[30] Foreign Application Priority Data

Sep. 20, 1991 [JP] Japan ..... 3-241746

[51] Int. Cl.[6] ..... G03G 15/00; G03G 15/16; G03G 21/00

[52] U.S. Cl. ..... 399/159; 399/297; 399/381

[58] Field of Search ..... 355/200, 210, 355/211, 311

[56] References Cited

U.S. PATENT DOCUMENTS

| | | | |
|---|---|---|---|
| 4,575,221 | 3/1986 | Onoda et al. | 355/200 |
| 4,863,821 | 9/1989 | Iino et al. | 430/58 |
| 4,882,256 | 11/1989 | Osawa et al. | 430/66 |
| 4,939,056 | 7/1990 | Hotomi et al. | 430/66 |
| 5,059,502 | 10/1991 | Kojima et al. | 430/66 |
| 5,183,719 | 2/1993 | Yagi et al. | 430/66 |
| 5,190,824 | 3/1993 | Itoh | 428/408 |

FOREIGN PATENT DOCUMENTS

| | | |
|---|---|---|
| 1-281990 | 11/1989 | Japan . |
| 2-99693 | 4/1990 | Japan . |
| 2-54543 | 11/1990 | Japan . |
| 3-62042 | 3/1993 | Japan . |

*Primary Examiner*—Fred L. Braun

*Attorney, Agent, or Firm*—Burns, Doane, Swecker & Mathis, LLP

[57] ABSTRACT

In a process for image formation, an electrostatic latent image is formed on a photosensitive member having an amorphous carbon layer as an outermost surface layer. The electrostatic latent image is developed with toner to form a toner image. The toner image is transferred to transfer paper of which pH-value according to JIS-P-8133 is in a range from 7.0 to 8.5.

12 Claims, 2 Drawing Sheets

PROCESS FOR IMAGE FORMING USING A PHOTOSENSITIVE MEMBER HAVING AN AMORPHOUS CARBON LAYER AS AN OUTERMOST SURFACE LAYER

This application is a continuation of application Ser. No. 07/946,679, filed Sep. 18, 1992, now abandoned.

BACKGROUND OF THE INVENTION

1. Field of the Invention

The present invention relates to a process for image forming which uses a photosensitive member having an amorphous carbon layer as an outermost surface layer, and predetermined transfer paper.

2. Description of the Related Art

In electrophotographic image forming apparatuses, organic members have been widely used as photosensitive members for forming electrostatic latent images and toner images, because the organic photosensitive members are superior to inorganic photosensitive members in view of sanitation and manufacturing costs. However, in general, the organic photosensitive members have a low surface hardness. Even if they initially had good chargeability and photosensitivity, these good characteristics may be impaired due to scratching of the surfaces and/or abrasion of the photosensitive layers which are caused by friction with sheets of transfer paper, cleaning members, developer and/or others during repeated copying operations.

In recent years, in accordance to demand for high-speed operation and high quality image resolution of copying machines and printers, it has been desired to provide a photosensitive member having a good durability. For this reason, there has been proposed a photosensitive member including a protective layer formed of an amorphous carbon layer over the surface of the organic photosensitive member. The amorphous carbon layer is very hard, and use of the surface protective layer formed of such film can provide the organic photosensitive member having good durability without impairing the electrostatic characteristics of the base photosensitive layer.

However, the photosensitive member having the surface protective layer formed of the amorphous carbon layer has such a disadvantage that the image resolving ability reduces as it is repetitively used.

The reason for this is that loading material such as talc, kaolin and clay as well as other electrolytes such as metallic oxide, which are component of paper powder of the transfer paper used in the conventional electrophotography, adhere to and accumulate on the surface of the amorphous carbon layer, which reduces a surface resistance of the photosensitive member.

On the other hand, the photosensitive member having the low surface hardness, i.e., the photosensitive member, which does not have the amorphous carbon layer as the outermost surface, does not have a significant problem even if the electrolyte contained in the transfer paper adheres thereto, because the electrolyte is scraped off when the surface of the photosensitive member is shaved off due to the friction with the member such as the cleaning member. Conversely, the surface resistance of the photosensitive member having a high surface hardness reduces when it is repetitively used, because the electrolyte adhered to the surface of the amorphous carbon layer is not scraped off and thus accumulates thereon. The amorphous carbon layer has a high surface activity, and the electrolyte itself adhered thereto is ionized by ozone and ion generated during the charging operation, which further reduces the surface resistance of the photosensitive member.

Therefore, it is necessary to eliminate or remarkably reduce the electrolyte contained in the transfer paper. The inventors have studied in various aspects how to overcome the above-noted disadvantages and have found that the content of the electrolyte component, which is liable to be ionized, in the transfer paper can be indirectly measured by the pH-value measuring method JIS-P-8133 defined by the Japanese Industrial Standards. Based on these studies and findings, the present invention has been developed.

SUMMARY OF THE INVENTION

Accordingly, it is an object of the invention to provide a process for image forming ,which can prevent reduction of a surface resistance of a photosensitive member having an amorphous carbon layer as an outermost surface layer for a long term.

Another object of the invention is to provide a process for image forming which can maintain a good image resolving ability for a long term.

These objects are achieved by eliminating or significantly reducing a quantity of electrolyte in transfer paper, and more specifically by a process for image forming including the steps of forming an electrostatic latent image on a photosensitive member having an amorphous carbon layer as an outermost surface layer, forming a toner image by developing the electrostatic latent image with toner, and transferring the toner image to transfer paper having a pH-value between 7.0 and 8.5 measured according to JIS-P-8133.

The measurement of the pH value of paper according to JIS-P-8133 is carried out as follows.

The pH of paper is expressed by a hydrogen ion concentration of extract of paper, which is macerated or cut into small pieces, and is obtained by measuring the acidity or alkalinity thereof. The Japanese Industrial Standard (P-8133) prescribes a cold water extraction method and a hot water extraction method. The method to be actually selected between them is dependent on the purpose of the test. According to the pH testing method, a specimen is formed of a piece of paper of about 1.0 g to be tested. This piece is cut into pieces of about 1 $cm^2$ or less without contaminating them, e.g., by sweat on the hand. If the specimen is formed of thick sheets of paper having a thickness of 0.3 mm or more, or is formed of sheets of paper having a high density a, Korner macerator is used to pulverize and mix them. Distilled water used for this test contains carbon dioxide but has a pH-value between 6.2 and 7.2 (20°±5° C.). If the distilled water is alkaline, its pH must be not more than 7.3 after it was boiled for two minutes and thereafter was cooled. If the pH-value was more than 7.3 after the boiling, potassium permanganate and sodium hydroxide are added at ratios of about 1 g/lit. and 4 g/lit. to the water, respectively, and then the water is distilled.

The cold water extraction method is carried out as follows.

The specimen is put into a test cup of 100 ml (milliliter) and distilled water of 20 ml is added thereto. The specimen is softened by a stirring rod having a flat end. Distilled water of 50 ml is added and is stirred. The cup is covered with a watch glass and is maintained at 20°±5° C. for about one hour. Thereafter, it is stirred, and then the pH is measured with a glass electrode pH meter without filtration.

The hot water extraction method is carried out as follows.

Similarly to the cold water extraction, the specimen is put into an Erlenmeyer flask of 100 ml, and water of 70 cc is added thereinto. The specimen is softened with a glass rod. A cooling pipe is associated to the flask, and the flask is put in a hot water bath, which can maintain the content at a temperature between 90° and 100° C. without boiling the water. The flask is sometimes shaken. After the heating for one hour, it is cooled to 20°±5° C., and the pH of the extract is measured with the glass electrode pH meter. The test is carried out two times. The results are averaged and rounded to one decimal, and the result thus processed is reported together with a supplementary note indicating the cold water extraction or the hot water extraction. A major part of the glass electrode pH meter (JIS-Z-8802) used for the test is shown in FIG. 3. The glass electrode GE is provided at its tip end with a thin film of glass, and liquid of pH 7.0 is held inside the film. When the glass electrode GE is immersed into the liquid LI to be tested, a potential difference, which has a constant relationship to hydrogen ion concentrations of the internal liquid and the liquid to be tested, is generated between these two types of liquid. This electrode GE is combined with a comparison electrode (calomel electrode) CE to form a cell for obtaining the pH of the liquid LI to be tested. Since the potential difference is an extremely small DC voltage, it is amplified in an AC conversion type DC amplifying method by an oscillation capacity convertor in the meter (main body), whereby the pH-value can be directly read on a scale.

The foregoing and other objects, features, aspects and advantages of the present invention will become more apparent from the following detailed description of the present invention when taken in conjunction with the accompanying drawings.

DETAILED DESCRIPTION OF THE PREFERRED EMBODIMENT

Embodiments of a process for image forming according to the invention will be described below together with examples for comparison. In all the embodiments and examples, a copying machine CP in FIG. 2 described layer is used.

[Embodiment 1]

Transfer paper used in this embodiment contains loading material (heavy calcium carbonate), whereby a pH-value thereof according to JIS-P-8133 is set at 8.5. The pH-values are measured by the cold water extraction method. The heavy calcium carbonate was processed as follows. Limestone is roughly crushed, and then is subjected to wet grinding, e.g., by a ball mill. Subsequently, elutriation is carried out, and collected particles are dried. Alternatively, the limestone may be crushed into particles in a dry condition, and then may be screened for collecting fine powder.

[Embodiment 2]

Transfer paper used in this embodiment contains loading material (precipitated calcium carbonate), whereby a pH-value thereof is set at 7.9. The precipitated calcium carbonate is obtained by filtering, drying and crushing precipitate which is formed by blowing carbon dioxide into milk of lime.

[Embodiment 3]

Transfer paper used in this embodiment contains, as loading material, heavy calcium carbonate similarly to the embodiment 1 and talc, whereby a pH-value thereof is adjusted to be 7.0. The composition Of talc is $Mg_3Si_4O_{10}(OH)_2$, and contains, as major components, $SiO_2$ and MgO, as well as small amounts of $Al_2O_3$, FeO and others.

[Embodiment 4]

Transfer paper used in this embodiment contains precipitated calcium carbonate, similarly to the embodiment 2, whereby a pH-value thereof is set at 7.9.

[Example 1 for Comparison]

Transfer paper contains talc, which is similar to the embodiment 3, and has a pH value of 5.1.

[Example 2 for Comparison]

Transfer paper contains loading material (clay) and has a pH-value of 6.2. The clay contains $SiO_2$ as a major component, and also contains $Al_2O_3$, $Fe_2O_3$, CaO, MgO and $K_2O$.

Copying operations were carried out by the copying machine CP, using the paper in the embodiments 1–4 and examples 1 and 2 for comparison. For each kind of paper, the image resolving ability of the photosensitive drum was evaluated after the copying operation of one hundred thousand sheets (100K printing). The result is shown in Table 1.

The photosensitive drum includes an overcoat formed of an amorphous carbon layer, as will be described later in detail. The evaluation of the image resolving ability was carried out in the following manner.

Figure 1:
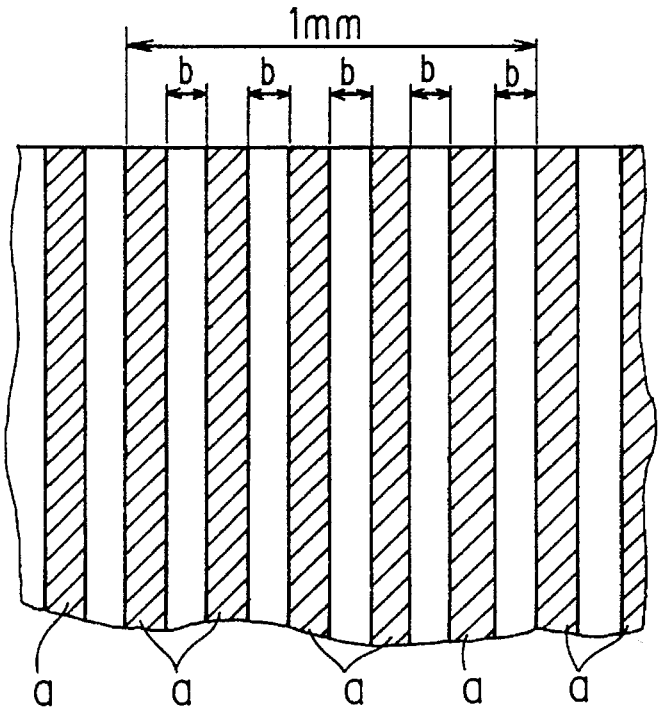
FIG. 1 shows an original image used for evaluating an image resolving ability of a photosensitive member.

As shown in FIG. 1, an original document to be copied includes equally spaced lines a at a density of 5 lines/mm. The lines a each have a width of thickness of 100 μm and are spaced by a distance b of 100 μm from each other. For the transfer paper of the respective embodiments and examples for comparison, the copying machine in FIG. 2 was initially adjusted to have the resolution allowing the reproduction of 5 lines/mm. After the 100K printing, if the reproduction of 5 lines/mm was allowed, the evaluation was marked with "O". If not allowed, the evaluation was marked with "X".

TABLE 1

| | Embodiments | | | | Examples | |
|---|---|---|---|---|---|---|
| | 1 | 2 | 3 | 4 | 1 | 2. |
| loading material | Heavy $CaCO_3$ | Pre. $CaCO_3$ | Heavy $CaCO_3$ + talc | Pre. $CaCO_3$ | Talc | Clay |
| pH | 8.5 | 7.9 | 7.0 | 7.9 | 5.1 | 6.2 |
| Developer | A | A | B | B | B | A |
| Resolving Power at 100K Printing | O | O | O | O | X | X |

Figure 2:
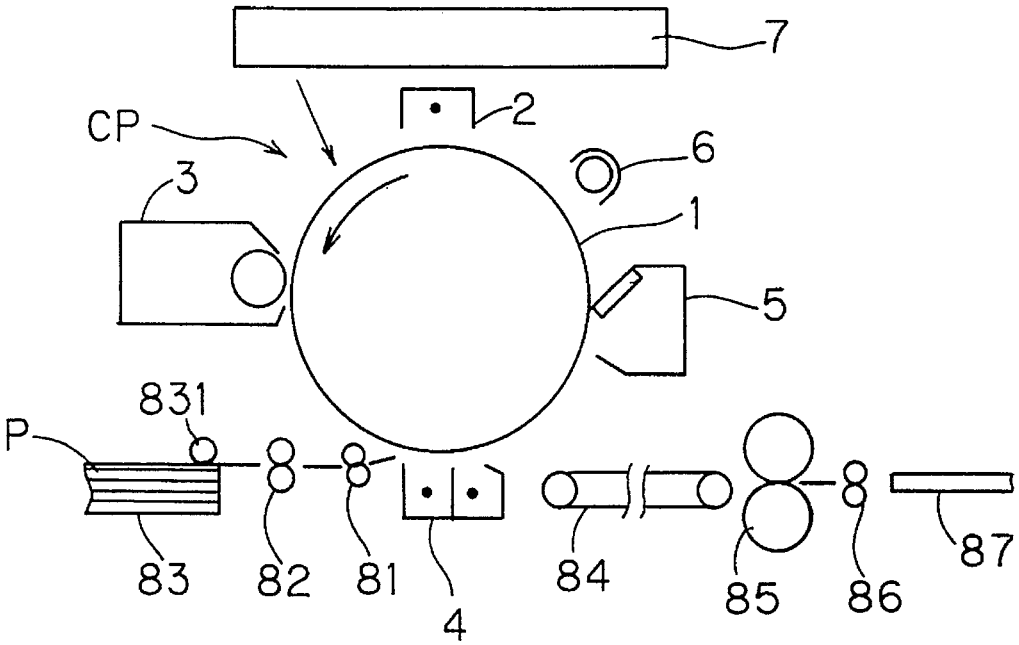
FIG. 2 schematically shows a construction of a copying machine used for evaluating an image resolving ability of a photosensitive member.
Figure 3:
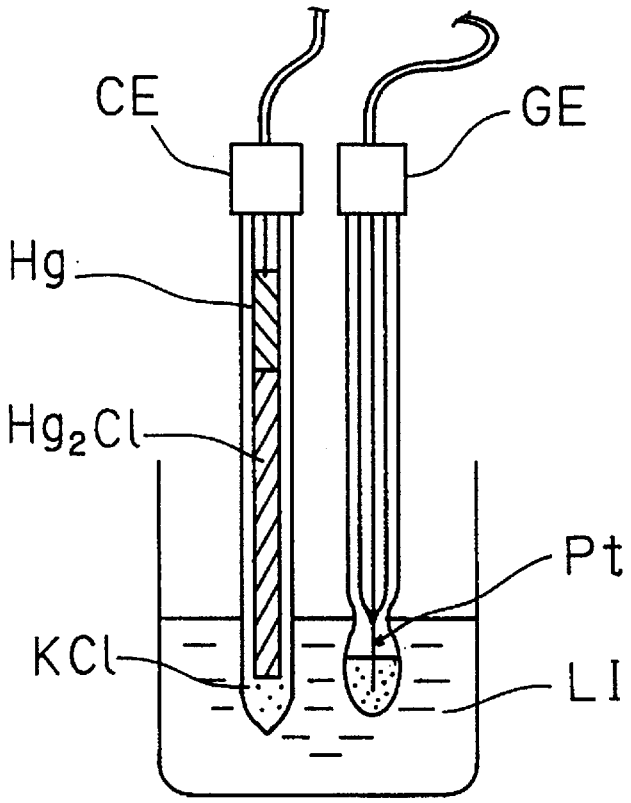
FIG. 3 schematically shows a major part of a glass electrode pH meter.

Now, the copying machine used for the evaluation will be described below with reference to FIG. 2. The copying machine CP is provided at its central portion with a photosensitive drum 1, and is also provided with an electric charger 2, developing device 3, transfer/separator charger 4, cleaner 5 and eraser 6 disposed around the drum 1. Above the photosensitive drum 1, an optical system 7 is disposed for irradiating the light onto the original image and carrying out exposure on the surface of the drum 1 in accordance with the image. At the upstream to the transfer/separator charger 4, there are disposed a timing roller pair 81, an intermediate roller pair 82 and a sheet feeder cassette 83. Downstream with respect to the transfer/separator charger 4, there are disposed a transporting belt 84 for the transfer sheet, a fixing roller pair 85, a discharging roller pair 86 and a discharged sheet tray 87. The developing device 3 utilizes two-component developer of which major components are toner and carrier.

The photosensitive drum 1 is driven to rotate counterclockwise in the figure. The surface of the drum 1 is subjected to the image exposure by the optical system 7, whereby an electrostatic latent image is formed thereon. The latent image is developed by the developing device 3 into an toner image, which is moved to a transfer region. On the other hand, a transfer sheet P, i.e., a sheet of transfer paper, is drawn from the sheet feeder cassette 83 by a sheet feeder roller 831, and is passed through the intermediate roller pair 82 to the timing roller pair 81, from which the sheet is sent to the transfer region in synchronization with the toner image. To the transfer sheet P sent to the transfer region, the transfer/separtor charger 4 transfers the toner image formed on the drum 1, and subsequently separates the sheet P from the drum 1. Then, the sheet P is sent through the transporting belt 4 to the fixing roller pair 85, at which the toner image is fixed, and then is discharged by the discharge roller 86 to the discharged sheet tray 87.

The photosensitive drum 1 includes a function-separated, negatively chargeable organic photosensitive layer having a good sensitivity to the relative luminosity band, and a surface protective layer located over the photosensitive layer. The surface protective layer is an amorphous carbon layer (a-C:H) produced from gas containing hydrocarbon by plasma decomposition reaction.

The photosensitive layer includes a charge generating layer and a charge transporting layer located on the charge generating layer. The charge generating layer is formed as follows. Azo compound, which is expressed by the following constitutional formula 1, of 0.45 weight parts, polyester resin (Biron 200, Toyo Bouseki Co., Ltd.) of 0.45 weight parts, and cyclohexanone of 50 weight parts are put into a sand grinder and are dispersed for 24 hours to obtain photosensitive liquid, of which coefficient of viscosity is 20 cp at 20° C. This liquid is applied by a dipping method onto a cylindrical base member having an outer diameter of 80 mm, a length of 340 mm and a thickness of 2 mm. After the drying, the charge generating layer of 0.3 μm in thickness is completed. The cylindrical base member is made from aluminium alloys containing magnesium at 0.7 wt. % and silicon at 0.4 wt. %. The drying is carried out in circulating air at 20° C. for 30 minutes.

[Constitutional Formula 1]

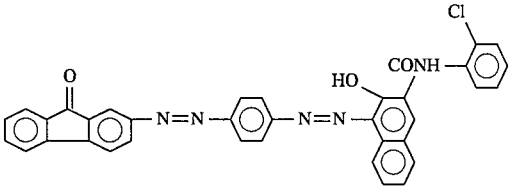

The charge transporting layer is formed as follows. Liquid is applied to the charge generating layer by the dipping method. This liquid contains styryl compound of 10 weight parts, which is expressed by the following constructional formula 2, and polycarbonate resin (Panlite K-1300, Teijin Kasei Co., Ltd.) of 7 weight parts which are solved into the solvent containing 1,4-dioxane of 40 weight parts. The applied liquid is dried and thereby the charge transporting layer of 32 μm in thickness is completed. The coefficient of viscosity of the applied liquid is 240 cp at 20° C. The drying is carried out in the circulating air at 100° C. for 30 minutes.

[Constitutional Formula 2]

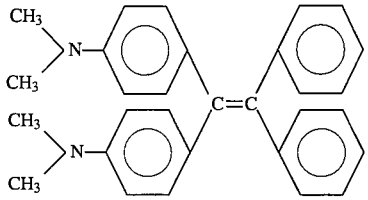

The photosensitive member is formed of the function-separated organic photosensitive layer, which includes the charge generating layer and the charge transporting layer independently disposed thereon, as well as the amorphous carbon layer, i.e., surface protective layer on the photosensitive layer. However, the photosensitive member, to which the transfer paper according to the invention may be applied, is not limited to this construction.

The invention may utilize a so-called "reversely stacked layer type" photosensitive layer in which the charge generating layer is located over the charge transporting layer as well as the amorphous carbon layer covering the photosensitive layer, and may also utilize the photosensitive member which includes a so-called "single layer type" photosensitive layer having both the charge generating function and the charge transporting function as well as the amorphous carbon layer covering the photosensitive layer. The invention may utilize the photosensitive member, in which the photosensitive layer itself is formed of the amorphous carbon layer. The charge generating material, charge transporting material, binder resin and others may be appropriately selected from the various kinds of known material.

Inorganic material such as zinc oxide, cadmium sulfide, selenium contained alloy and amorphous silicon contained alloy may be used.

Further, an undercoat layer may be employed for improving the charging performance, image quality, adhesive property and others.

The material for the undercoat layer may be resin such as ultraviolet-setting resin, cold-setting resin and thermosetting resin, or resin mixture including the above resin and the resistance adjusting material dispersed therein, as well as thin-film material which is formed into a thin film by the vacuum deposition or ion plating of the metallic oxide, the metallic sulfide or others, amorphous carbon processed by the plasma polymerization, amorphous silicon carbide processed by the plasma polymerization, or others.

The photosensitive member may include various kinds of base material provided that the surface is electrically conductive, and may be of a shape, other than the cylindrical shape, such as a flat shape or a belt-like shape. The surface of the basic member may be subjected to the roughening treatment, oxidation treatment and/or coloring treatment.

The amorphous carbon layer is formed in accordance with the following plasma decomposition reaction method disclosed in the U.S. patent Ser. No. 4,882,256.

The cylindrical base mender, which is provided with the photosensitive layer and serves as a ground electrode, is disposed in a plasma decomposition reaction chamber for rotation. A distance of 38 mm is set between the ground electrode and a power application electrode. Material gas (butadiene 15 sccm) and carrier gas (hydrogen 200 sccm) are introduced into the reaction chamber, and the reaction chamber is maintained at a predetermined degree of vacuum of 1 Torr for film formation. The base member is rotated at 5 rpm, while maintaining the same at 50° C. The power of 100 KHz and 150 W is applied to the power application electrode to generate the plasma, whereby the surface protective layer, i.e., amorphous carbon layer (a-C:H) of 0.11 μm in thickness is formed after a film forming time of three minutes. The Vickers hardness of this surface protective layer is in a range from 200 to 1000.

The amorphous carbon layer thus formed may contain impurity such as oxygen and nitrogen as well as periodic table III group atom, IV group atom and V group atom, if necessary. Even in this case, the transfer paper according to the invention is effective for maintaining the image resolving ability of the photosensitive member.

For the evaluation of the image resolving ability of the photosensitive drum 1, the developing device 3 of the copying machine CP used the developer A in the embodiments 1 and 2 and the example 2, and used the developer B in the embodiments 3 and 4 and the example 1, as shown in the Table 1. The specification of the developer is as follows.

Developer A

Toner

Styrene-n-butyl methacrylate resin (softening point: 132° C. glass transition point: 60° C.) of 100 weight parts, carbon black (Mitubishi Kasei Co., Ltd., MA#8) of 5 weight parts, nigrosine dye (Orient Kagaku Co., Ltd., Bontron N-01) of 3 weight parts and low-molecular-weight polypropylene (Sanyo Kasei Kogyo Co., Ltd., Biscol 550P) of 2 weight parts are sufficiently mixed by a ball mill, and then is kneaded by three rolls heated to 140° C. After the natural cooling, the material is roughly crushed by a whizzer mill and then is pulverized by a jet mill. Then, air classification is carried out to obtain the positively chargeable toner having a mean diameter of 9 μm. The toner thus formed is subjected to after-treatment for the actual use, using Colloidal Silica R-974 (trade name, manufactured by Nippon Aerogical Co., Ltd.) of 0.01 weight part per toner amount of 100 weight parts.

Carrier

Polyester resin (softening point 123° C., glass transition point 65° C., AV23, OHV40) of 100 weight parts, Fe—Zn contained ferrite particles (TDK Co., Ltd., MRP-2) of 500 weight parts and carbon black (Mitsubishi Kasei Co., Ltd., MA#8) of 2 weight parts are sufficiently mixed and crushed by a Henschel mixer, and then is subjected to melting and kneading by an extrusion kneader of which cylinder and cylinder head are set at 180° C. and 170° C., respectively. After the cooling, the kneaded material is roughly crushed by the whizzer mill and is further crushed by the jet mill. The crushed material is classified by the classifier to obtain the carrier having the mean particle diameter of 60 μm.

Developer B

Toner

Styrene-n-butyl methacrylate resin (softening point: 132° C., glass transition point: 60° C.) of 100 weight parts, carbon black (Mitubishi Kasei Co., Ltd., MA#8) of 5 weight parts, spiron black TRH of 3 weight parts and low-molecular-weight polypropylene (Sanyo Kasei Kogyo Co., Ltd., Biscol 550P) of 2 weight parts are sufficiently mixed by a ball mill, and then are kneaded by three rolls heated to 140° C. After the natural cooling, the material is roughly crushed by a whizzer mill and then is pulverized by a jet mill. Then, air classification is carried out to obtain the negatively chargeable toner having a mean diameter of 9 μm. The toner thus formed is subjected to after-treatment for the actual use, using Colloidal Silica R-974 (trade name, manufactured by Nippon Aerogical Co., Ltd.) of 0.01 weight part per toner amount of 100 weight parts.

Carrier

The carrier is the same as that in the developer A.

As can be seen from the Table 1, the transfer paper of the embodiments of the invention can maintain the good image resolving ability of the photosensitive drum 1 even after the 100K printing.

According to the invention, as described hereinabove, the photosensitive member having the amorphous carbon layer as the outermost surface layer is combined with the particular transfer paper, whereby the reduction of the surface resistance of the photosensitive members can be prevented, and thus the reduction of the image resolving ability of the photosensitive member can be prevented.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A process for image formation comprising the steps of:

forming an electrostatic latent image on a photosensitive member having an amorphous carbon layer as an outermost surface layer;

developing said electrostatic latent image with toner to form a toner image;

transferring said toner image onto transfer paper contacting with said photosensitive member; and cleaning residual toner remaining on the surface of said photosensitive member by a cleaning blade disposed in contact with the surface after the transfer;

wherein said transfer paper has a pH-value of 7.0 to 8.5 according to JIS-P-8133 to maintain an electrical resistance and charge retaining property of the photosensitive member.

2. A process for image forming according to claim 1, wherein said transfer paper contains loading material.

3. A process for image forming according to claim 1, wherein a Vickers hardness of said outermost surface layer of said photosensitive member is in a range from 20 to 1000.

4. A process for image forming according to claim 3, wherein said outermost surface layer is a photosensitive layer.

5. A process for image forming according to claim 3, wherein said outermost surface layer is a surface protective layer.

6. A process for image forming according to claim 1, wherein said photosensitive member is an organic photosensitive member.

7. A process for image formation comprising the steps of:

forming an electrostatic latent image on a photosensitive member having an amorphous carbon layer as an outermost surface layer;

developing said electrostatic latent image with toner to form a toner image;

electrically transferring said toner image onto transfer paper contacting with said photosensitive member; and, cleaning residual toner remaining on the surface of said photosensitive member by cleaning blade disposed in contact with the surface after the transfer;

wherein said transfer paper is not thermal transfer recording paper and said transfer paper has a pH-value of 7.0 to 8.5 according to JIS-P-8133 to maintain an electrical resistance and charge retaining property of the photosensitive member.

8. A process for image forming according to claim 7, wherein said transfer paper contains loading material.

9. A process for image forming according to claim 7, wherein a Vickers hardness of said outermost surface layer of said photosensitive member is in a range from 20 to 1000.

10. A process for image forming according to claim 9, wherein said outermost surface layer is a photosensitive layer.

11. A process for image forming according to claim 9, wherein said outermost surface layer is a surface protective layer.

12. A process for image forming according to claim 7, wherein said photosensitive member is an organic photosensitive member.

* * * * *